United States Patent [19]

Simms

[11] Patent Number: 4,825,779

[45] Date of Patent: May 2, 1989

[54] TABLE FOR TOILET

[76] Inventor: Kenneth B. Simms, 7454 Race Rd., Hanover, Md. 21076

[21] Appl. No.: 121,106

[22] Filed: Nov. 16, 1987

[51] Int. Cl.[4] ..... A47B 35/00

[52] U.S. Cl. ..... 108/50

[58] Field of Search ..... 108/50, 93, 32, 28; 298/441.1; 312/233, 37, 39, 287, 140.2, 140.4; 242/55.2, 55.53

[56] References Cited

U.S. PATENT DOCUMENTS

| | | | |
|---|---|---|---|
| D. 267,760 | 2/1983 | Vrignaud | D6/523 |
| D. 290,433 | 6/1987 | Nusz | D6/523 |
| 569,135 | 10/1896 | Jackson | 108/93 X |
| 623,143 | 4/1899 | Doty | 108/50 |
| 827,913 | 8/1906 | Jensen | 108/32 |
| 1,876,681 | 9/1932 | Irwin | 108/32 |
| 2,546,851 | 3/1951 | Conrad | 108/50 X |
| 3,006,108 | 10/1961 | Condit | 108/50 X |
| 3,224,700 | 12/1965 | Heinle | 242/55.53 |
| 4,124,259 | 11/1978 | Harris | 242/55.53 |
| 4,223,964 | 9/1980 | Kilgore | 312/39 |
| 4,235,333 | 11/1980 | Boone | 242/55.53 X |
| 4,326,678 | 4/1982 | Hamm | 242/55.2 |
| 4,457,426 | 12/1985 | Siciliano | 242/55.53 |

*Primary Examiner*—Peter A. Aschenbrenner
*Attorney, Agent, or Firm*—John F. McClellan, Sr.

[57] ABSTRACT

A table specialized for toilet use has a spindle with exceptional access supporting a roll of toilet paper, a tabletop supported by legs at a height and an angle optionally usable by one seated in the ordinary way on a flush toilet seat. An edge retains objects such as reading material on the inclined table top, and a platform with spaced slats supports reading material and the like between floor and toilet paper roll. The roll retracts easily when pushed, so that any selected side of the table can be stored pushed against a wall.

1 Claim, 1 Drawing Sheet

TABLE FOR TOILET

FIELD OF THE INVENTION

This invention relates generally to furniture and particularly to a movable table of the type holding a roll of toilet paper.

BACKGROUND OF THE INVENTION

The toilet seat can more rightly be called "the throne" if certain conditions are met above and beyond the simple support and flush provisions. A supply of toilet paper needs to be furnished and at a convenient location or locations, not a marginally accessible location. A supply of reading material from which a selection can be made is usually welcome, and for some an ash tray, cigarettes and matches are needed. Some may prefer to prepare notes such as shopping lists, and these will need pencil and notepaper and backing for the note paper.

All these materials should be provided with best access but least probability of spillage or tipping.

The following U.S. patent disclosures are known to be pertinent to the present invention as follows:

U.S. Pat. No. Des. 26,700 issued to Guy Vrignaud on 2/1/83 showed a holder with table-like top; it could be set on a surface, but was too low to be used as a table;

Design U.S. Pat. No. Des. 290,433 issued to D. J. Nusz on 6/23/87, showed a combination storage cabinet and paper roll holder, but not free standing;

U.S. Pat. No. 4,124,259 issued to B. J. Harris on 11/7/78, disclosed a free-standing toilet paper holder with table-like top, access to roll of paper, and hinged door opening into storage space for extra rolls of toilet paper;

U.S. Pat. No. 4,557,425 issued to S. J. Sicilizno on 12/10/85, disclosed a cabinet that stood on floor, held rolls of toilet paper accessible for use, and had a storage area inside.

Further objects are to provide a system as described that is more convenient and safer than any system known like it, in that the top is of proper size and is conveniently slanted in a direction that will hold a magazine of conventional size in proper position for reading, but will deter the magazine (or ash tray) from sliding off the top. Still other objects are to provide a system as described that is easy to move about, that can be made tip-resistant and that will at the same time provide the most accessible and convenient storage for reading material.

And other objects are to provide a system as described that is easy to load with toilet paper and to remove a toilet paper roll therefrom.

Yet further objects are to provide a system that keeps the contents elevated above the floor, that gives good visual inspection to be sure that there is no fire from smoking, that has no accessible pockets for vermin, and of which any side can be pushed flat against the wall, and still further objects are to provide a system as described that is durable, sturdy, can be made in different sizes to suit applications, and that is handsome in appearance and large enough to be seen and not tripped over.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
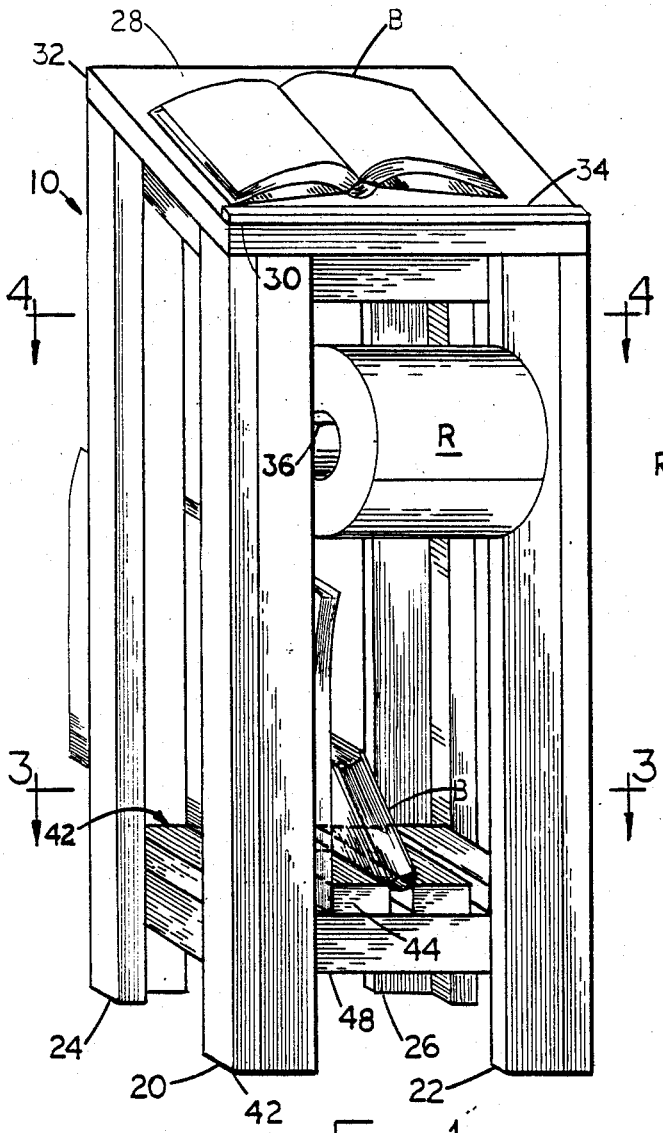
FIG. 1 is a rear perspective view of the preferred embodiment.
Figure 2:
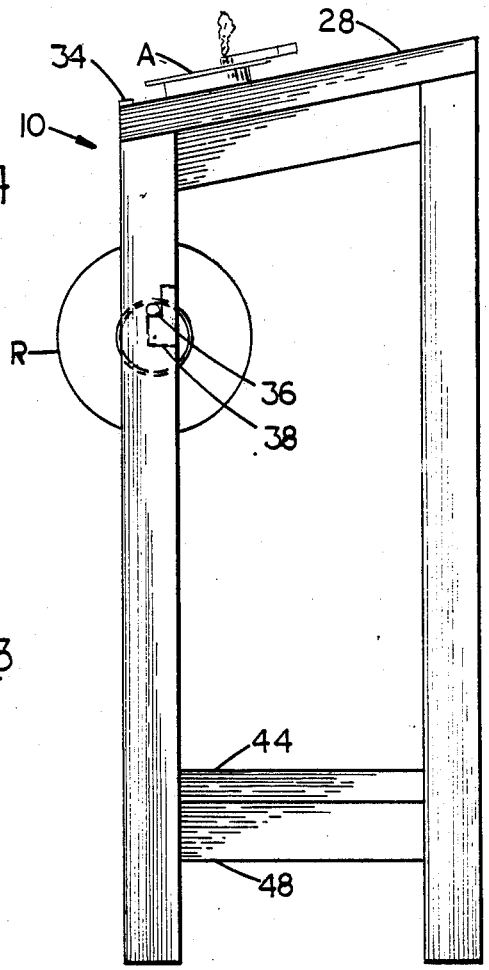
FIG. 2 is a side elevational view.

FIGS. 1 and 2 show the invention in embodiment 10. Pedestal structure in the form of two pairs of legs 20, 22, 24, 26 supports a top 28 large enough in size for a book B or an ash tray A and other smoker's articles to rest on it. The top 28 is angled downward toward the near or user side 30, the pair of legs 20, 22 at this side being shorter than the pair of legs 24, 26 at the far side 32. Preferably an angle of at least fifteen degrees is provided.

A ledge 34 along the lower or near side 30 of the top 28 safely prevents such reading material and/or the other articles from sliding off the top.

Figure 4:
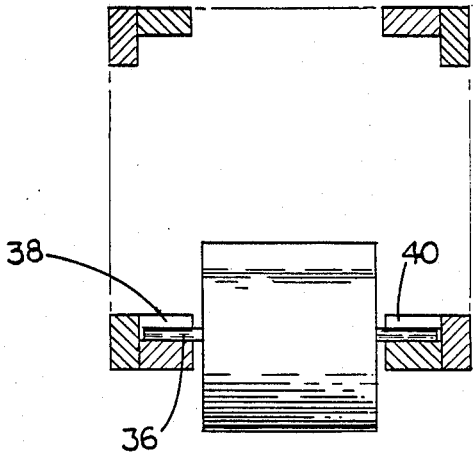
FIG. 4 is a plan sectional view from 4—4,FIG. 1.

A toilet paper roll R is supported by and between the near pair of legs 20, 22 by a spindle 36 held at each end in a socket 38, 40 formed as pieces secured to respective ones of the legs. Each leg is an angle in section, with vertex 42 out at a respective corner of the table. FIG. 4 shows "40".

Figure 3:
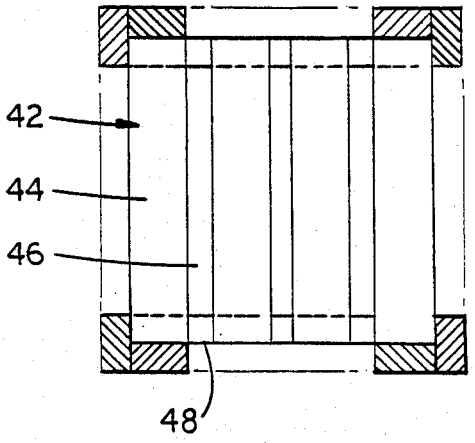
FIG. 3 is a plan sectional view from 3—3, FIG. 1.

FIGS. 1, 2 and 3 show that storage for books B, folded newspapers and the like is provide on slated platform 42, where they are prevented from slipping free by the spaced slats 44 and from slipping through the spaces 46, between the slats by cross members 48. Even if thicker than the openings they can lean against the legs and not slip because of support by the spaced slats. The platform structure holds books B up the legs, high and dry above the floor.

FIG. 4 shows that to remove the spindle, and any toilet paper roll on it, it is only necessary to lift the toilet paper roll. The spindle ends come up, free of the support. For easy handling, the edges of the roll of toilet paper protrude from the front of the tube, wherey they are always assessible. To put on a new roll, the user can simply insert the spindle with roll on it from inside; the visibility is good from the user side. The spindle is small in diameter relative to the spindle hole in the toilet paper and so that the roll retracts when pushed against a wall, any selected side thus being storable substantially flat against a wall.

Size of the system is as follows in a practical, known full size embodiment:

| | |
|---|---|
| Height of top above floor at highest portion | 24 inches (60 cm) |
| Height of top above floor at the lower edge | 22½ inches (58 cm) |
| Width of top, high edge to low edge | 9 9/16 inches (24 cm) |
| Width of top, side to side | 9½ inches (24 cm) |
| Spacing between legs at paper roll | 5 inches (13 cm) |
| Width, and also, length of platform | 8 inches (20.5 cm) |
| Spacing between slats | ¾ inch (2 cm) |
| Square below platform | 3 inches (8 cm) |
| Height of platform top | 5 inches (13 cm) |

It will be appreciated from the description that the table has no doors to swing open and tip it or catch passers-by, and that the inventor has provided an appealing looking, easily portable, sturdy and convenient table between the legs thereof, easily and economically made of wood or of plastic sheet and tubing, or of molded construction.

This invention is not to be construed as limited to the pasticular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent:

1. A table having two pairs of legs, and means for rotatively supporting a roll of toilet paper between the front pair of legs, comprising a spindle passed through said roll of toilet paper, and attached to said pair of legs; said table characterized by: means on top for holding a nominal size book at a reading angle to the horizontal, and at an elevation for reading by a person of nominal size seated on a nominal size flush toilet, and means for preventing a book at said reading angle from sliding off the top; said table characterized by: its portable construction and proper balance, allowing it to be picked up by its top, while reading material on top and below remains reasonably stationary; said table, comprising a storage area below, utilizing evenly spaced slats as dividers and stops for stored reading material.

* * * * *